United States Patent [19]

Benatar

[11] 4,264,059

[45] Apr. 28, 1981

[54] CONDITION RESPONSIVE CONTROL MEANS FOR USE IN DISCHARGING POWDERED REAGENT INTO A POOL OF MOLTEN METAL

[76] Inventor: Victor Benatar, 1191 Hopkins Ter., Atlanta, Ga. 30324

[21] Appl. No.: 129,580

[22] Filed: Mar. 12, 1980

[51] Int. Cl.[3] ..... C21B 7/24

[52] U.S. Cl. ..... 266/81; 75/52

[58] Field of Search ..... 266/81; 75/60, 51, 52

[56] References Cited

U.S. PATENT DOCUMENTS 3,897,047 7/1975 Kolb ..... 75/60

*Primary Examiner*—P. D. Rosenberg

*Attorney, Agent, or Firm*—Rodgers & Rodgers

[57] ABSTRACT

For use in a system for injecting powdered reagent into a pool of molten metal through a lance whose discharge end is submerged in molten metal and to which powdered reagent is conveyed by a flow of carrier gas, sensing means is arranged to derive a signal dependent upon the rate of flow of carrier gas to the lance and after predetermined time delay the signal is applied to control means so as to effect a shut off of the supply of powdered reagent and of the flow of carrier gas and to elevate the lance out of the pool of molten metal whenever the lance becomes clogged on the one hand or ruptured on the other.

12 Claims, 1 Drawing Figure

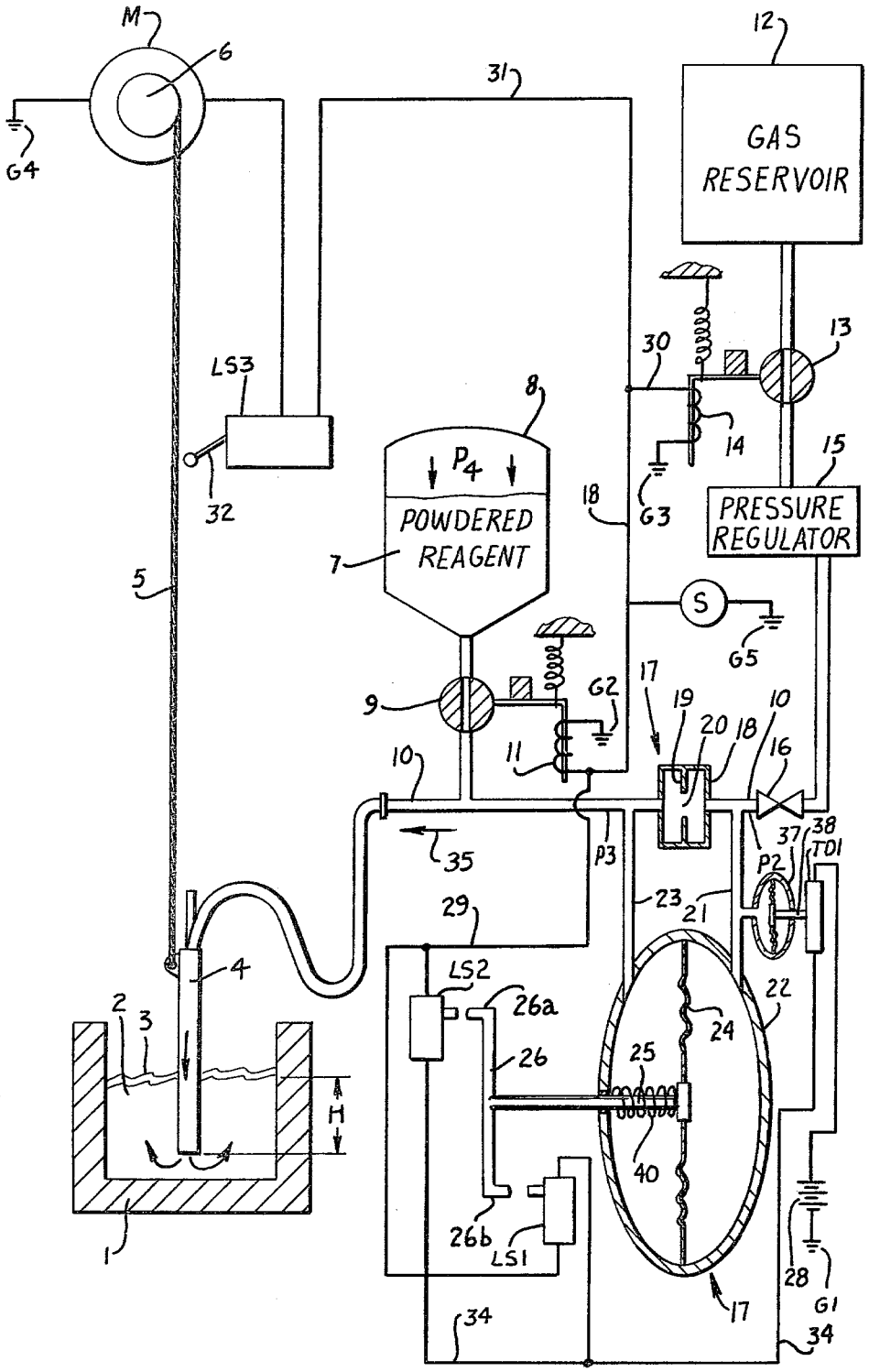
M
6
G4
31
12
GAS RESERVOIR
13
30
14
G3
15
PRESSURE REGULATOR
LS3
32
8
P4
POWDERED REAGENT
7
18
5
S
G5
9
G2
17
19
20
18
10
16
11
10
35
P3
37
38
TD1
P2
23
21
29
LS2
26a
4
2
3
22
24
26
25
H
40
26b
LS1
1
28
G1
17
34
34

CONDITION RESPONSIVE CONTROL MEANS FOR USE IN DISCHARGING POWDERED REAGENT INTO A POOL OF MOLTEN METAL

BACKGROUND ART

The injection of powdered, reagent such as magnesium powder, calcium silicide or calcium carbide powder into a pool of molten metal is effected by inserting a hollow elongated lance into the pool of metal and by forcing powdered reagent conveyed by carrier gas downwardly through the lance and into the metal pool in order to perform certain processes such as desulphurization of iron or steel or add alloying ingredients for example. The high temperature of the molten metal contrasted with the relatively low ambient temperature above the surface of the pool of metal imposes a severe stress on the lance and may effect a rupture thereof usually at the slag line at the surface of the pool of molten metal. Should this condition occur, flow of powdered reagent is diverted to the surface of the pool of metal rather than downwardly below the surface where it may become intermingled with the metal in a proper manner. Should the powdered reagent escape through a rupture in the lance at the surface of the pool of molten metal, the reagent is generally wasted and may constitute a dangerous fire hazard particularly if the reagent is in the form of magnesium powder or calcium carbide powder. It has been the practice to minimize the danger and waste of such a condition through the agency of an alert operator who manually shuts off the flow of reagent when the lance becomes ruptured. Of course this type of control is dependent upon the human element which is highly variable from individual to individual and of course is quite expensive.

Another cause for failure of a lance may be due to the fact that it becomes clogged by the reagent due to an insufficient rate of flow of the carrier gas or possibly due to the fact that the reagent may melt and then become solidified to a degree as it proceeds downwardly through the lance from its entry end to its exhaust end. This condition results in a choking or substantial reduction in the flow of carrier gas. In this instance it has been the practice to monitor the instruments indicating the rate of flow by means of an alert operator who when the condition develops simply shuts off the flow of reagent.

In either of the above instances in addition to shutting off the flow of reagent powder, the operator ordinarily promptly initiates elevation of the lance out of the pool of molten metal and also immediately shuts off the flow of carrier gas.

DISCLOSURE OF INVENTION

In accordance with this invention in one form, sensing means derives a signal which is a function of the rate of flow of carrier gas used to convey powdered reagent material through a lance whose discharge end is submerged in a pool of molten metal and such signal is supplied through appropriate time delay means to control means operable in coordination with the derivation of the signal for effecting a cutoff of the flow of powdered reagent to the lance together with a cutoff of the flow of carrier gas to the lance as well as the initiation and completion of a lance elevating operation whereby the lance is removed from the pool of molten metal. Preferably an indicating signal is also initiated such as a visual or audio signal so as to call attention to the defective lance so that an operator may quickly disconnect the defective lance and install a new lance and thereupon promptly resume the process of injecting powdered reagent into the molten metal.

BRIEF DESCRIPTION OF DRAWING

The single drawing FIGURE simply schematically discloses a pool of molten metal into which the lower end of a lance is submerged and to which powdered reagent is supplied by way of carrier gas together with sensing means formed according to the invention and arranged to derive a signal dependent on the rate of flow of carrier gas which initiates action of time delay means and of control means for initating removal of the lance from the pool of molten metal as well as shutoff of the powdered reagent and of the flow of carrier gas and which may also effect an indicating operation.

BEST MODE OF CARRYING OUT THE INVENTION

In the drawing the numeral 1 indicates a ladle or torpedo car which contains a pool 2 of molten metal such as iron or steel. The numeral 3 indicates slag which accumulates atop the pool of molten metal 2.

Submerged in the metal is a lance indicated by the numeral 4 which is of conventional construction and which is raised and lowered by means of a cable 5 associated with a wench 6 driven by motor M for lowering and elevating the lance 4 into and out of the pool of molten metal 2.

Powdered reagent 7 such as magnesium powder, calcium silicide or calcium carbide powder is contained within container 8 and is maintained therein at a pressure P4. The lower outlet of container 8 is controlled by supply valve 9 the outlet of which empties reagent into conduit 10 and thence through the lance 4. Supply valve 9 may be manually or pneumatically operated and also is arranged to be operated by means of a solenoid 11 which of course is of conventional construction.

For causing powdered reagent deposited into conduit 10 to flow through that conduit in the direction indicated by the arrow 35, a flow of carrier gas is established in conduit 10 so that powdered reagent is conveyed by the carrier gas and forced downwardly through the lance 4 and into the molten metal 2. Carrier gas is supplied from a reservoir 12 through a control valve 13 which is controlled by a solenoid 14 in conventional fashion. If desired, control valve 13 could be pneumatically operated. Gas having passed through control valve 13 then passes through pressure regulator 15, needle valve 16 and thence through the conduit 10 as described.

In normal operation of the system, the pressure P3 in conduit 10 at the exhaust port of valve 9 must be sufficiently high to overcome the frictional resistance of powder and gas flowing through conduit 10 and also must overcome the static head due to the weight of the molten metal in ladle 2. This head is indicated at H in the drawing and simply represents the height of metal from the lower end of lance 4 to the surface of the molten metal. Obviously pressure P4 in tank 8 must be somewhat greater than pressure P3 in order to insure that powdered reagent is properly inserted into conduit 10 in such fashion as to effect the desired operation such for example as proper desulphurization of the molten metal 2. Obviously there is a normal pressure in conduit 10 and a normal rate of flow of carrier gas through flexible conduit 10. One arrangement for determining the rate of flow of carrier gas through conduit 10 is indicated in the drawing as the sensing means generally indicated at 17. This sensing means is schematically represented by an orifice plate 19 in a holder 18. The carrier gas flows through the restriction 20 of the orifice plate 19 and a differential pressure is established between P2 and P3 which is dependent upon the flow rate through restriction 20. A conduit 21 connects the inlet of housing 18 with the interior of housing 22 while conduit 23 interconnects the outlet port of housing 18 with the pressure sensing housing 22. A diaphragm schematically represented at 24 divides chamber 22 into two parts and is provided with an operating rod 25 which in turn supports a cross head 26.

When the operation starts and valve 13 opens to allow the convey gas pressure to reach P2, the pressure causes pressure switch 37 to actuate time delay switch TD1. After a preset delay, TD1 closes and establishes a circuit from battery 28 to LS1 and LS2. This delay provides time to allow the circuit to come to an equilibrium condition following startup. During this delay the control means is rendered ineffective.

Under normal operating conditions where the rate of flow of carrier gas through the conduit 10 is at a normal rate, the pressure differential between P2 at the inlet to housing 18 and P3 at the outlet from that housing is great enough to move the operating rod 25 and the crosshead 26 out to an intermediate position. If however the lance becomes ruptured, the rate of flow of carrier gas increases substantially and the differential pressure between P2 and P3 increases so that it exerts an increased force on the right hand surface of diaphragm 24 which is sufficient to move the operating rod 25 and the cross head 26 substantially to the left against the force of spring 40. When the end portion 26*a* of cross head 26 engages limit switch LS2 that switch is actuated and establishes a circuit from electric battery 28 one terminal of which is grounded as indicated at G1 through switch TD1, conductor 34, LS2, conductor 29 and relay 11 to ground G2. This effects automatic closing of valve 9 and shuts off the flow of powdered reagent. The signal supplied to conductor 29 also is supplied through signal device S to ground GS. Signal S may be of the visual or audible type and a signal is also supplied through conductor 30 to relay 14 and ground G3 to effect automatic closing of control valve 13 and by this means shuts off the flow of carrier gas from reservoir 12. Simultaneously with the above operations, a signal is supplied through conductor 31 and normally closed limit switch LS3 to motor M and ground G4 which in turn operates to elevate the lance 4 out of the pool of molten metal 2 until such time as the upper end of the lance 4 engages the switch arm 32 of limit switch LS3 to shut off the flow of current to motor M. Under these conditions the system is completely deactivated.

The use of the time delay switch TD1 is necessary because conditions similar to that just described in connection with a ruptured lance also occurs when the system is started up from an inactive condition. During this circumstance, a rapid initial flow of gas occurs which to the sensing means 17 appears to represent a ruptured lance but which in reality simply represents an abnormal rate of flow of carrier gas which occurs during start up. Thus the time delay switch TD1 is necessary to prevent operation of the system during start up for a time sufficiently long to allow the start up rate of flow to become reduced to a normal rate of flow and thus to prevent inadvertent operation of the protective system during start up. Of course the switch TD1 is conventional and could constitute a dash pot controlled switch.

While the rate of flow of carrier gas through the conduit 10 is greatly increased above the normal rate of flow due to a cracked lance, the rate of flow of carrier gas due to a clogged lance is reduced substantially below normal. Thus under these conditions, pressure P3 and pressure P2 become substantially the same and the spring 40 causes rod 25 to move to the right, causing 26*b* to actuate LS1. When the end 26*b* contacts the switch LS1, a circuit is completed from electric battery 28 through conductor 34, conductor 29 to solenoid 11 and effects closure of supply valve 9 and thus shuts off the flow of reagent 7. As before a signal is conveyed through indicating device S and also through conductor 18 and relay 14 to ground G3 so as to effect closure of valve 13 thus to shut off the flow of carrier gas from reservoir 12. Simultaneously a signal is supplied through conductor 31 and normally closed limit switch LS3 to motor M and ground G4 which effects operation of motor M and wench 6 to elevate lance 4 out of the pool of molten metal 2 to a level determined by switch LS3.

INDUSTRIAL APPLICABILITY

While this invention is especially well adapted for use in conjunction with desulphurization processes in which powdered reagent material is intermingled with molten metal such as iron or steel, the invention is not limited to this specific application but may also be used advantageously in other systems for injecting powder into a liquid.

I claim:

1. In a system for injecting powdered reagent into a pool of molten metal through a lance which is lowered from above into the pool of molten metal and to which the powdered reagent is conveyed by a flow of carrier gas, an arrangement for responding to a defective operating condition of the lance which causes a change in the rate of flow of the carrier gas and which comprises sensing means for deriving a signal whose magnitude is dependent upon the rate of flow of carrier gas to the lance, and control means whose operation is dependent upon the derivation of said signal and which is operable to effect a system control operation.

2. An arrangement according to claim 1 wherein time delay means actuated by the initiation of the flow of carrier gas is arranged to render said control means ineffective for a predetermined time following the initiation of the flow of carrier gas.

3. An arrangement according to claim 1 wherein a signal derived by said sensing means which is below a predetermined magnitude indicates a substantailly clogged condition of the lance which impedes or prevents the normal discharge of powdered reagent into said pool of molten metal through the discharge end of said lance.

4. An arrangement according to claim 1 wherein a signal derived by said sensing means which is above a predetermined magnitude indicates a ruptured condition of the lance which allows an abnormal discharge of powdered reagent through the ruptured wall of the lance rather than normally through the discharge end thereof.

5. An arrangement according to claim 1 wherein the signal derived by said sensing means comprises a pressure differential.

6. An arrangement according to claim 5 wherein the carrier gas is arranged to flow through orifice means and wherein the signal is a function of the difference in pressure at the inlet and outlet of said orifice means.

7. An arrangement according to claim 3 wherein time delay means actuated by a signal which indicates the beginning of the flow of carrier gas following shut down of the system initiates actuation of said control means only after a predetermined time interval following the beginning of the flow of carrier gas and after the derivation of a signal by said sensing means which indicates a clogged condition of the lance.

8. An arrangement according to claim 4 wherein time delay means actuated by a signal which indicates the beginning of the flow of carrier gas following shut down of the system initiates actuation of said control means only after a predetermined time interval following the beginning of the flow of carrier gas and after the derivation of a signal by said sensing means which indicates a ruptured condition of the lance.

9. An arrangement according to claim 1 wherein a reagent container is interconnected with a conduit for the carrier gas through a supply valve and wherein said control means is arranged to initiate closing of said supply valve.

10. An arrangement according to claim 1 wherein lance manipulating means is arranged to lower and to raise the lance into and out of the pool of molten metal and wherein said control means is arranged to initiate raising of the lance by said lance manipulating means.

11. An arrangement according to claim 1 wherein a carrier gas reservoir is interconnected with a conduit for the carrier gas through a control valve and wherein said control means is arranged to initiate closing of said control valve.

12. An arrangement according to claim 1 wherein a signal device is actuated by said control means to indicate the defective condition.

* * * * *